US010590902B2

(12) United States Patent
Florijancic et al.

(10) Patent No.: US 10,590,902 B2
(45) Date of Patent: Mar. 17, 2020

(54) STARTER FOR AN INTERNAL COMBUSTION ENGINE

(71) Applicant: Mahle International GmbH, Stuttgart (DE)

(72) Inventors: Tadej Florijancic, Most Na Soci (SI); Sebastjan Kobal, Sempas (SI)

(73) Assignee: Mahle International GmbH (DE)

( * ) Notice: Subject to any disclaimer, the term of this patent is extended or adjusted under 35 U.S.C. 154(b) by 41 days.

(21) Appl. No.: 15/761,080

(22) PCT Filed: Sep. 13, 2016

(86) PCT No.: PCT/EP2016/071483
§ 371 (c)(1),
(2) Date: Mar. 16, 2018

(87) PCT Pub. No.: WO2017/046043
PCT Pub. Date: Mar. 23, 2017

(65) Prior Publication Data

US 2018/0266380 A1 Sep. 20, 2018

(30) Foreign Application Priority Data

Sep. 18, 2015 (EP) ..... 15185791

(51) Int. Cl.
*F02N 15/00* (2006.01)
*F02N 15/02* (2006.01)
(Continued)

(52) U.S. Cl.
CPC ..... *F02N 15/067* (2013.01); *F02N 11/087* (2013.01); *H01F 7/081* (2013.01);
(Continued)

(58) Field of Classification Search
CPC ... H01H 51/065; F02N 11/087; F02N 15/067; F02N 11/0851; F02N 2015/061; H01F 7/1607
See application file for complete search history.

(56) References Cited

U.S. PATENT DOCUMENTS 2,419,333 A * 4/1947 Christiansen ..... H01F 7/1607 335/263
5,563,563 A * 10/1996 Freitas ..... H01H 1/04 335/126
(Continued)

FOREIGN PATENT DOCUMENTS

DE 2822164 A1 11/1979
DE 102013016548 B3 2/2015
FR 2902230 A1 12/2007

OTHER PUBLICATIONS

English abstract for DE-2822164.
Chinese Office Action dated Mar. 13, 2019 related to corresponding Chinese Patent Application No. 201680053685.3.

*Primary Examiner* — Jake Cook
(74) *Attorney, Agent, or Firm* — Fishman Stewart PLLC

(57) ABSTRACT

A starter for an internal combustion engine may include a support, an electric motor for driving a pinion in rotation, and a solenoid drive configured to axial adjust the pinion between an active position and a passive position. The solenoid drive may include a ferromagnetic plunger stop, a plunger axially adjustable, and a cylindrical coil arrangement surrounding a cylindrical coil interior. The plunger stop may include a cylindrical section projecting into the coil interior. The plunger may be arranged axially opposite the cylindrical section and, when the pinion is in the active position, protruding axially into the coil interior. When the pinion is in the passive position, a face-side plunger end may be arranged axially in a proximal end portion. The cylin-
(Continued)

drical section may extend into the coil interior such that a face end is closer to the proximal end portion than to a distal end portion.

22 Claims, 2 Drawing Sheets

(51) Int. Cl.

| | |
|---|---|
| ***F02N 15/06*** | (2006.01) |
| ***F02N 11/08*** | (2006.01) |
| ***H01F 7/08*** | (2006.01) |
| ***H01F 7/121*** | (2006.01) |
| ***H01F 7/16*** | (2006.01) |
| ***H01H 51/06*** | (2006.01) |
| *H01H 50/16* | (2006.01) |

(52) U.S. Cl.
CPC ..... *H01F 7/121* (2013.01); *H01F 7/1607* (2013.01); *H01H 51/065* (2013.01); *F02N 11/0851* (2013.01); *F02N 2015/061* (2013.01); *H01F 2007/086* (2013.01); *H01H 50/163* (2013.01)

(56) References Cited

U.S. PATENT DOCUMENTS

| | | | | |
|---|---|---|---|---|
| 6,130,595 | A | 10/2000 | Niimi | |
| 7,315,230 | B2 * | 1/2008 | Hoffman | H01F 7/1607 335/255 |
| 7,569,787 | B2 | 8/2009 | Kurasawa et al. | |
| 8,421,565 | B2 | 4/2013 | Santichen et al. | |
| 2004/0032309 | A1 | 2/2004 | Kajino et al. | |
| 2006/0038645 | A1 * | 2/2006 | Hoffman | H01F 7/1607 335/220 |
| 2007/0246015 | A1 * | 10/2007 | Moreno | F16K 31/06 123/458 |
| 2010/0271155 | A1 | 10/2010 | Kaneda et al. | |
| 2014/0278020 | A1 | 9/2014 | Neet | |

* cited by examiner

STARTER FOR AN INTERNAL COMBUSTION ENGINE

CROSS-REFERENCE TO RELATED APPLICATIONS

This application claims priority to International Patent Application No. PCT/EP2016/071483, filed on Sep. 13, 2016, and European Patent Application No. 15185791.9, filed on Sep. 18, 2015, the contents of both of which are hereby incorporated by reference in their entirety.

TECHNICAL FIELD

The present invention relates to a starter for an internal combustion engine.

BACKGROUND

A starter of said type comprises a support, an electric motor which is arranged on the support and which serves for driving a pinion in rotation, and a solenoid drive which is arranged on the support and which serves for the axial adjustment of the pinion between an active position, which is provided for the drive of a gearwheel of the internal combustion engine, and a passive position, which is axially offset with respect to the active position. The solenoid drive comprises a plunger stop which is static with respect to the support, a plunger which is axially adjustable relative to the plunger stop, and a cylindrical coil arrangement which is arranged on the plunger stop and which surrounds a cylindrical coil interior of the coil arrangement in a circumferential direction. Furthermore, the plunger stop has a cylindrical section which projects axially into the coil interior.

For the starting of the internal combustion engine, the solenoid drive is activated so as to transfer the pinion of the electric motor from the passive position into the active position. In the active position, the pinion meshes with a gearwheel of the internal combustion engine, which may be formed for example on a flywheel of a drivetrain of the internal combustion engine. The electric motor then drives the pinion, which in turn drives said gearwheel, whereby a crankshaft of the internal combustion engine is set in rotation in order to start the internal combustion engine. When the internal combustion engine has started and its crankshaft is driven by reciprocating movements of the pistons of the internal combustion engine, the solenoid drive is operated such that the pinion is returned from the active position into the passive position. In the passive position, the pinion disengages from said gearwheel, that is to say no longer meshes with the latter.

To be able to adjust the pinion from the passive position into the active position and to be able to hold the pinion fixed in the active position, the coil arrangement must provide relatively large magnetomotive force in order to draw the plunger into the coil interior, and hold it there, for the active position. Since, for the purposes of a failsafe design, the plunger is preferably drawn into the coil interior counter to the action of a restoring spring, relatively high magnetic forces are required in particular to hold the plunger static in the active position of the pinion, such that the coil arrangement is supplied with a correspondingly high level of electrical power.

The pinion normally has a circumferential toothing with axially extending teeth. Complementary with respect to this, the gearwheel of the internal combustion engine likewise has a circumferential toothing with axially running teeth.

Upon a transfer of the pinion from the passive position into the active position, the teeth of the pinion engage into tooth spaces of the gearwheel. However, in many situations, axially leading tooth flanks of the teeth of the pinion do not pass directly into the tooth spaces of the toothing of the gearwheel but strike axial tooth flanks of the teeth of the gearwheel. In order that the teeth of the pinion nevertheless find their way into the tooth spaces of the gearwheel and can engage therein, the electric motor of the starter may be actuated so as to effect a rotation of the pinion already during the adjustment of the pinion from the passive position into the active position. Said rotation for the threading-in of the pinion into the gearwheel is expediently performed with a considerably reduced torque and/or with a considerably reduced rotational speed in relation to the subsequent starting process, when the pinion is fully engaged with the gearwheel.

Owing to the relatively high magnetic force with which the plunger is drawn into the coil interior, as described above, the pinion may, by way of its axially leading tooth flanks, collide with the opposite axial tooth flanks of the gearwheel with corresponding intensity, increasing the wear of the toothings of pinion and gearwheel. Furthermore, the toothings may bear against one another by way of the axial tooth flanks with a relatively high force, whereby a correspondingly high level of friction must be overcome in order to rotate the pinion relative to the gearwheel such that the toothing of the pinion can mesh with the toothing of the gearwheel. As a result, there is the risk of increased wear here too.

A generic starter is known for example from U.S. Pat. No. 8,421,565 B2. To solve the abovementioned problem, in the case of a known starter, said document proposes a complex construction of the coil arrangement within the solenoid drive, wherein a retraction coil for pulling the plunger into the coil interior and a holding coil for holding the plunger that has been pulled into the coil interior are arranged axially separately from one another. It is also proposed that the plunger be equipped, on its outer circumference, with an encircling groove which, in the passive position, is situated radially opposite an edge region circumferentially surrounding a passage opening, through which the plunger extends axially, of a face side wall of a solenoid housing. In this way, in the passive position, there is a radial gap between plunger and edge region. As the plunger is retracted into the coil interior, the circumferential groove moves into the coil interior and thereby departs from the abovementioned edge region of the face side wall, such that said edge region is subsequently situated radially opposite a plunger longitudinal section adjoining the circumferential groove. As the plunger is retracted, therefore, a radial spacing between said edge region and an outer side of the plunger is varied, specifically reduced, whereby the density of the magnetic field lines transmitted from said edge region to the plunger when the coil arrangement is activated is varied, specifically increased. The density of the magnetic field lines however correlates with the acting magnetic forces. The circumferential groove formed on the plunger thus yields a reduction in the acting magnetic forces at the start of the retraction movement of the plunger when the pinion is to be transferred from the passive position into the active position. The known measures are however relatively cumbersome to realize. Furthermore, the attractive force that pulls the plunger into the coil interior is reduced only to a relatively small extent by the annular groove, as said annular groove ultimately merely effects a deflection of the field lines. Also, the annular groove is maintained and, even when the plunger has been retracted into the coil interior, causes a deflection of the field lines in the plunger, thus reducing the attainable magnetic forces.

SUMMARY

The present invention is concerned with the problem of specifying, for a starter of the type mentioned in the introduction, an improved or at least different embodiment which is characterized by reduced wear of the pinion and/or of the gearwheel that interacts therewith. In particular, it is sought to specify an advantageous or alternative way of reducing the acting magnetic forces at the start of the adjustment of the pinion between the passive position and the active position.

Said problem is solved according to the invention by the features of the independent claim(s). The dependent claim(s) relate to advantageous embodiments.

In accordance with the inventive solution, the invention is based on the general concept of axially lengthening the cylindrical section of the plunger stop into the solenoid housing interior such that said cylindrical section comes into proximity of the face side wall of the solenoid housing. In other words, the cylindrical section of the plunger stop is extended from the distal end portion of the solenoid housing into said housing interior towards the proximal end portion in such a way, that an axial distance between a face end of the cylindrical section and a face side wall, facing the cylindrical section, of a solenoid housing, is accordingly reduced. Additionally, this extending length of the cylindrical section of the plunger stop causes a respective change of the position of a plunger. A face-side plunger end, facing towards the cylindrical section of the plunger stop, of the plunger is in the passive position of the pinion, at least radially at the outside, arranged axially in the area of a proximal edge region of the face side wall, bordering the passage opening in the circumferential direction. In this way, in the passive position of the pinion, the plunger is, in effect, more or less absent as a magnetic transmitter between the solenoid housing and the plunger stop.

Alternatively or additionally, the present inventive solution can also be based on the general concept of designing and arranging the plunger such that, in the passive position of the pinion, a face-side plunger end, facing towards the cylindrical section, of said plunger is, at least radially at the outside, arranged axially in the area of a proximal end portion of the coil arrangement. At least in the active position of the pinion the plunger protrudes from the proximal end portion into the coil interior, while the cylindrical portion of the plunger stop extends from a distal end portion of the coil arrangement into the coil interior. In this way, in the passive position of the pinion, a gap or interruption is realized in the path of the magnetic field lines from a solenoid housing via the plunger into the plunger stop. Owing to the fact that the plunger, in the passive position of the pinion, is arranged in the area of the proximal end portion of the coil arrangement, the plunger is, in effect, more or less absent as a field line transmitter between the solenoid housing and the plunger stop. Additionally, this changed position of the plunger in the passive position causes a respective change of the position of a face end of the cylindrical section facing the plunger. In particular, the cylindrical section of the plunger stop extends from the distal end portion of the coil arrangement into the coil interior towards the proximal end portion in such a way, that an axial distance between said face end of the cylindrical section and a side wall, facing the cylindrical section, of a solenoid housing, is accordingly reduced.

Both aforementioned solutions result in a changed position of the plunger in the passive position together with a reduced distance between said ferromagnetic face side wall of the ferromagnetic solenoid housing and said face end of the ferromagnetic cylindrical section of the ferromagnetic plunger stop, and therefore cause a deviation of a significant portion of the magnetic flux in such a way, that said portion of magnetic flux bypasses the plunger and goes directly from the face side wall to the face end. This deviated portion of magnetic flux thus cannot induce magnetic force into the plunger. Therefore, the magnetic force acting on the plunger at the start of the adjustment movement is correspondingly reduced. The reduced field lines, and an associated reduced field line density in the region of the plunger, reduce the magnetic forces which act on the plunger so as to draw the plunger into the coil interior when the coil arrangement is energized. In order to move the pinion into the active position, the plunger then moves into the coil interior, then the plunger is incorporated to an increasing extent into the transmission of the magnetic field lines, whereby the field line density in the region of the plunger increases. Thus, the magnetic forces acting on the plunger also increase.

The plunger, which interacts with the coil interior, is expediently composed of a ferromagnetic material and is at least that region of a component, movable axially relative to the coil arrangement and relative to the plunger stop, whose outer cross section substantially fills the inner cross section of the coil interior. In particular, an axial elongation, which may be provided, of said movable component, which axial elongation has an outer cross section considerably reduced, that is to say reduced by at least 50%, in relation to the inner cross section of the coil interior, does not count as part of the plunger, regardless of whether said elongation is attached as a separate component to the plunger or is formed integrally with said plunger.

According to the invention, the cylindrical section of the plunger stop extends into the coil arrangement in such a way that a face end, facing towards the plunger, of the cylindrical section is arranged closer to the proximal end portion of the coil arrangement than to the distal end portion of the coil arrangement. In other words, the cylindrical section extends over more than 50% of an axial length of the coil arrangement. Preferably, the cylindrical section extends over at least 70% of the axial length of the coil arrangement. More preferably, the cylindrical section extends into the coil arrangement such that the face end of the cylindrical section is arranged in an area of 70% to 90% of the axial length of the coil arrangement distal to the distal end portion of the coil arrangement.

According to another embodiment the cylindrical section has a cylindrical radial outer wall which axially ends at the face end of the cylindrical section. Additionally, the face end of the cylindrical section has a radial outer rim at the cylindrical outer wall. Preferably, the radial outer rim is arranged closer to the proximal end portion than to the distal end portion.

According to another embodiment the cylindrical section has a cylindrical radial outer wall which axially ends at the face end of the cylindrical section, wherein the radial outer wall of the cylindrical section extends over more than 50% of an axial length of the coil arrangement. Preferably, the radial outer wall of the cylindrical section extends over at least 70% of the axial length of the coil arrangement.

In a preferred embodiment can be provided that the face end of the cylindrical section extends in a plane which extends perpendicular to the axial direction of the cylindrical section.

Preferably, said plunger is, at least radially at the outside, fully or almost fully deployed axially out of the coil interior. In such a position of the plunger the aforementioned deviation or bypassing of magnetic field lines in view of the plunger is increased.

In one advantageous refinement, the solenoid drive may have a magnetically conductive, in particular ferromagnetic, solenoid housing which is fastened to the support, which, in a face side wall, has a passage opening extended through axially by the plunger, and in which the coil arrangement is arranged. Said solenoid housing may in particular be coupled to the plunger stop such that, at least in the retracted or active state of the plunger, a circuit for magnetic field lines is made possible or facilitated, such that said magnetic field lines, outside the coil interior, extend from the plunger stop, through the solenoid housing and through the face side wall to the plunger, and then return via the plunger within the coil interior and back to the plunger stop. This yields a particularly efficient magnetic field which pulls the plunger into the coil interior and holds it there.

In a preferred embodiment can be provided that the solenoid housing has an edge region bordering the passage opening in a circumferential direction, wherein the edge region has an axial length which is greater than an axial spacing between the face-side plunger end and the face end of the cylindrical section in the passive position.

In another embodiment the solenoid housing has an edge region bordering the passage opening in a circumferential direction, wherein the edge region has an axial length which is at least 30% of an axial length of the plunger. Preferrably, the edge region has an axial length which is also at least 30% of a diameter of the plunger.

In one advantageous refinement, it may be provided that the face side wall is, in an edge region bordering the passage opening in a circumferential direction, spaced apart axially from a face end, facing toward the face side wall, of the cylindrical section, and is, at least radially at the inside, arranged entirely axially outside the coil interior. In this way, an interruption between the plunger stop and the solenoid housing is realized, which, depending on the relative position of the plunger, can be filled to a greater or lesser extent by the plunger, whereby the magnetic field lines and thus also the acting magnetic forces vary in a manner dependent on the relative position of the plunger.

In an advantageous refinement, it may be provided that, in the passive position, aforementioned face-side plunger end facing toward the cylindrical section of the plunger stop is arranged in the area of an inner side, facing toward the cylindrical section, of the face side wall of the solenoid housing at least in the edge region thereof. This permits an advantageous alignment of the field lines for the start of the adjustment movement of the plunger. In particular said face-side plunger end, in the passive position, can project, at least radially at the outside, axially in the direction of the cylindrical section beyond said inner side of the face side wall. Alternatively, it may also be provided that, in the passive position, the plunger end terminates substantially flush with the inner side of the face side wall. It is likewise conceivable that, in the passive position, the inner side projects slightly beyond the plunger end in the direction of the cylindrical section.

In another embodiment, it may be provided that, in the active position, a face-side plunger end facing toward the cylindrical section of the plunger stop bears axially against a face end, facing toward the face side wall, of the cylindrical section. In this way, the plunger end forms, with the face end, an axial abutment for defining the active position. The plunger end and face end preferably bear areally against one another, whereby the field line interruption is eliminated in the active position. Furthermore, it is preferable for the plunger end and/or the face end to be of planar form with respect to a plane running perpendicular to the longitudinal direction. The longitudinal direction, which corresponds to the axial direction, is in this case defined by the bidirectional adjustment movement of the plunger.

In another advantageous refinement, the edge region may be in the form of a sleeve, the axial length of which is greater than the axial adjustment travel of the plunger covered by the latter between the active position and the passive position. It is achieved in this way that, via the edge region, a relatively high field line density can be transmitted to the plunger, which permits particularly high magnetic forces when the plunger is in the retracted state. In an alternative embodiment the axial length of the sleeve may also be smaller that said axial adjustment travel.

In another advantageous embodiment, the plunger may be mounted in axially adjustable fashion in a cylindrical guide sleeve which extends coaxially through the coil interior and which is supported radially on the cylindrical section. The guide sleeve simplifies the linear guidance of the plunger. Furthermore, the guide sleeve may have a reduced coefficient of friction in relation to the plunger.

In an advantageous refinement, the coil arrangement may be supported radially at the inside on the guide sleeve. This yields a minimal spacing between the coil arrangement and cylindrical cross section of the plunger stop. In addition or alternatively, the edge region of the face side wall of the solenoid housing may be supported radially at the inside on the guide sleeve. Thus, the plunger is guided on the guide sleeve even as far as into the edge region.

In another advantageous embodiment, the plunger may be coupled by way of a diverting lever to a drive shaft, which is connected rotationally conjointly to the pinion, for the purpose of axially adjusting said drive shaft, such that, during a transfer of the pinion from the passive position into the active position, the plunger and pinion are adjusted in opposite directions. It is expediently the case that, when the coil arrangement is activated, the plunger is pulled into the coil interior, while at the same time the pinion is deployed relative to the electric motor.

In another advantageous embodiment, it may be provided that the plunger is connected by way of a switching rod to a contact element for the electrical connection of two electrical contacts which connect the electric motor to a main electrical supply of the electric motor. In this case, the switching rod is expediently led coaxially through the plunger stop, such that the plunger stop is situated axially between the plunger and the contact element. In this way, the plunger performs a dual function, as it serves firstly for the adjustment of the pinion between the active position and the passive position, while at the same time also serving for the control or switching of the electrical contacts and thus of the main electrical supply of the electric motor. The electric motor is supplied with electrical energy by way of said main electrical supply as soon as the pinion has reached the active position. Only then does the electric motor drive the pinion with the high torques required for the starting of the internal combustion engine.

In an advantageous refinement, at least one restoring spring may be provided between the plunger and the cylindrical section of the plunger stop, which at least one restoring spring is arranged coaxially with respect to the switching rod and may expediently project axially into a recess formed in the plunger and/or into a recess formed in the cylindrical section. In the event of a deactivation of the coil arrangement or deenergization of the coil arrangement, the restoring spring effects an automatic deployment of the plunger out of the coil interior in order to adjust the pinion back into the passive position. By means of the restoring spring, it is also possible to realize a more failsafe design (failsafe principle).

In another advantageous refinement, it may be provided that, in the passive position, the contact element bears axially against a face end, facing away from the plunger, of the plunger stop. In this way, the contact element is provided with an additional function, as it defines the intended relative position of the plunger for the passive position of the pinion.

In another advantageous embodiment, the coil arrangement may have a coil support which has a cylindrical body and two end discs, between which at least one electrical coil of the coil arrangement is arranged radially at the outside. In this way, the coil support and the at least one coil form a pre-assemblable structural unit which can be mounted on the plunger stop, in order for the plunger stop with the coil structural unit mounted thereon to be inserted into the solenoid housing.

In one refinement, the coil support may bear by way of one of its end discs axially against an annular step of the plunger stop. This simplifies the realization of a structural unit composed of coil support with at least one coil and plunger stop. This plunger stop structural unit can be inserted particularly easily into the solenoid housing.

At least two different electrical coils may be mounted on the coil carrier. For example, a retraction coil and a holding coil may be provided which may be arranged axially separately on the coil carrier or else may be arranged radially one inside the other. It is likewise conceivable for the two coils to form a double winding.

Further important features and advantages of the invention will emerge from the subclaims, from the drawings and from the associated description of the figures on the basis of the drawings.

It is self-evident that the features mentioned above and the features yet to be discussed below may be used not only in the respectively specified combination but also in other combinations or individually, without departing from the scope of the present invention.

Preferred exemplary embodiments of the invention are illustrated in the drawings and will be discussed in more detail in the following description, wherein the same reference signs are used to denote identical or similar or functionally identical components.

DETAILED DESCRIPTION

Figure 1:
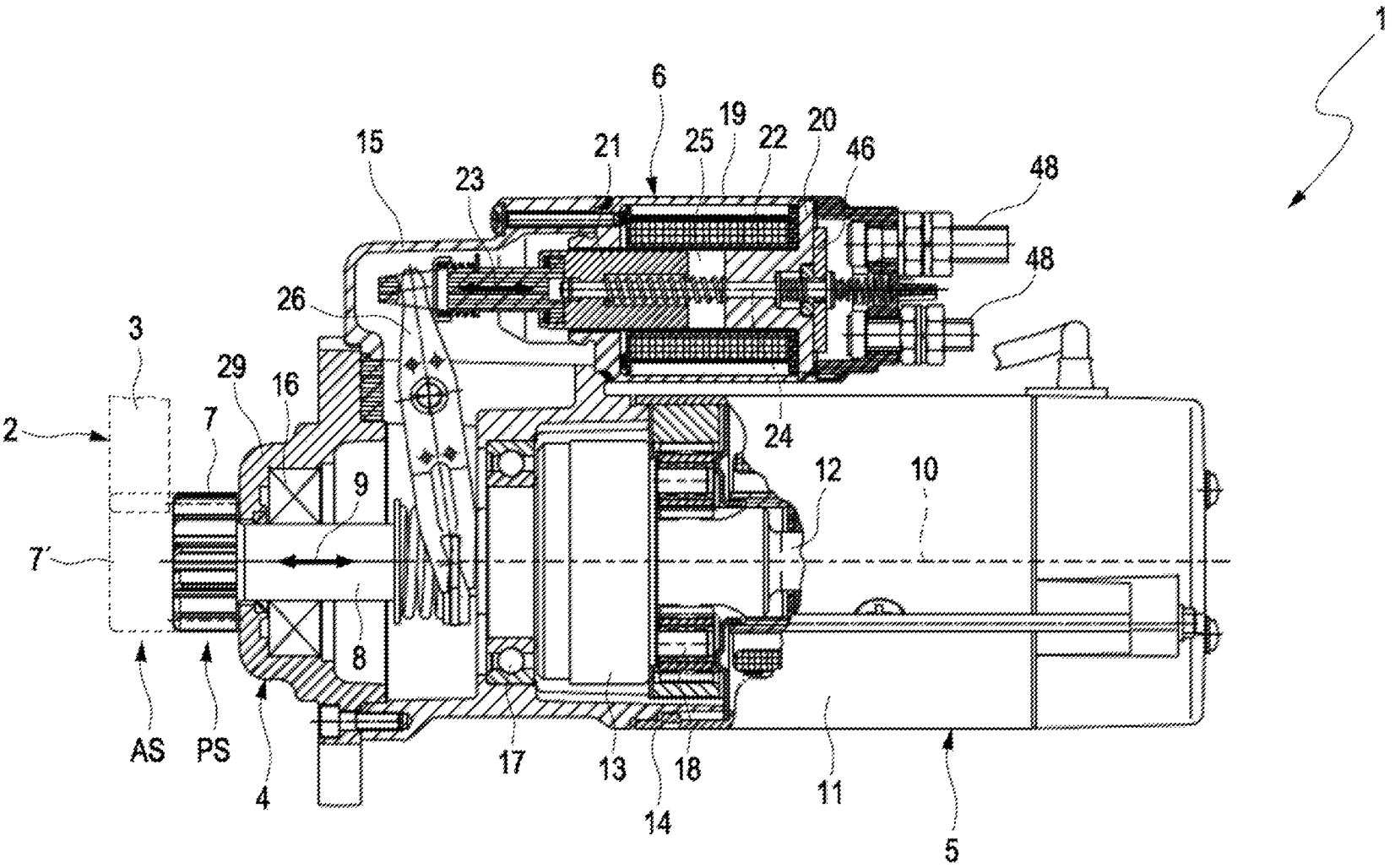
FIG. 1 shows a side view, partially in longitudinal section, of a starter with a conventional solenoid drive.

In accordance with FIG. 1, a starter 1 which is provided for starting an internal combustion engine 2, of which, in FIG. 1, only a gearwheel 3 is indicated by way of dashed lines, comprises a support 4, an electric motor 5 and a solenoid drive 6. The gearwheel 3 is incorporated in a suitable manner into a drivetrain (not shown in any more detail here) of the internal combustion engine 2, such that said gearwheel is connected in terms of drive to a crankshaft of the internal combustion engine 2 if the internal combustion engine 2 is, as is preferred, a piston engine with a crankshaft. The gearwheel 3 may for example be formed on a flywheel of the drivetrain.

The support 4 is designed for fastening the starter 1 to the internal combustion engine 2 or to a peripheral of the internal combustion engine 2 which may be situated for example in a vehicle which is equipped with the internal combustion engine 2.

The electric motor 5 is arranged on the support 4 and serves for driving a pinion 7 in rotation. The pinion 7 serves for driving the gearwheel 3 when the internal combustion engine 2 is to be started by way of the starter 1. For this purpose, the pinion 7 can, together with a drive shaft 8 on which the pinion 7 is rotationally conjointly arranged, be adjusted bilinearly in an axial direction 9, which is defined by an axis of rotation 10 of the drive shaft 8 or of the electric motor 5, between a passive position PS, which is shown in FIG. 1 by solid lines, and an active position AS, which is indicated in FIG. 1 by dashed lines. In said active position AS, the pinion is denoted by the reference sign 7'. In the active position AS, the pinion 7' serves for driving the gearwheel 3 and thus meshes with the latter such that a rotation of the pinion 7' forces a rotation of the gearwheel 3. In the passive position PS, the pinion 7 is axially offset with respect to the active position AS, specifically to such an extent that it does not mesh with the gearwheel 3. In this respect, the pinion 7 is then arranged axially spaced apart from the gearwheel 3.

The electric motor furthermore has, in the conventional manner, an external stator 11 and an internal rotor 12, wherein the rotor 12 is connected in terms of drive to the drive shaft 8 by way of a transfer device 13. The transfer device 13 may have a clutch, in particular a one-way friction clutch. The transfer device 13 may additionally or alternatively have a gear transmission 18, in particular a planetary gear train. The stator 11 is accommodated in a stator housing 14 which is fastened to the support 4. In the situation shown, the support 4 has a base housing 29, which serves for the fastening of the starter 1 to said peripheral, and an intermediate housing 15, which is fastened to the base housing 29. In the example shown, the stator housing 14 is now fastened to said intermediate housing 15.

The drive shaft 8 is mounted by way of a main bearing 16 on the support 4 or on the base housing 29 thereof. A further bearing 17 is provided in the intermediate housing 15 for additional support of the drive shaft 8.

The solenoid drive 6 has a solenoid housing 19 which is fastened to the support 4, specifically to the intermediate housing 15 thereof. The solenoid drive 6 serves for the axial adjustment of the pinion 7. For this purpose, the solenoid drive 6 has a plunger stop 20 which is static with respect to the support 4, a plunger 21 which is axially adjustable relative to the plunger stop 20, and a cylindrical coil arrangement 22. An axial direction 23 of the axial adjustability of the plunger 21 is defined by a longitudinal central axis 24 of the solenoid drive 6. The solenoid drive 6 is expediently arranged on the support 4 so as to be parallel and adjacent to the electric motor 5, such that the longitudinal central axis 24 extends parallel to the axis of rotation 10.

The coil arrangement 22 is arranged on the plunger stop 20 and surrounds a cylindrical coil interior 25 in a circumferential direction about the longitudinal central axis 24. The plunger 21 is coupled by way of a diverting lever 26 to the drive shaft 8 such that, for the adjustment of the pinion 7 from the passive position PS into the active position AS, the plunger 21 is retracted into the coil interior 25. Accordingly, the coil arrangement 22 is in the form of a retraction coil which, when energized, pulls the plunger 21 into the coil interior 25. The diverting lever 26 in this case effects a reversal of the movement direction, such that the retraction of the plunger 21 toward the right in FIG. 1 effects a deployment of the pinion 7 toward the left in FIG. 1.

Figure 2:
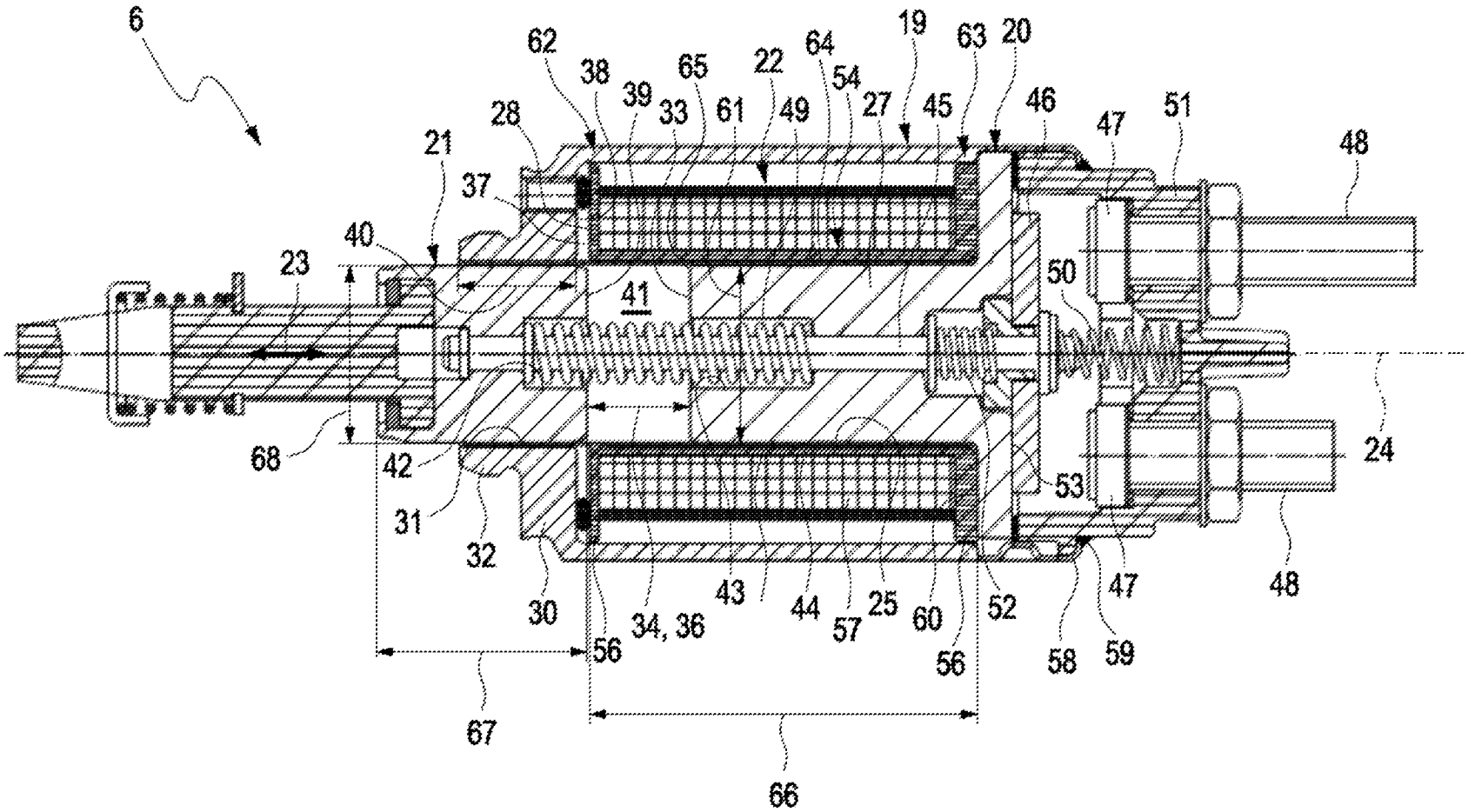
FIG. 2 shows a longitudinal section through a solenoid drive according to the invention.

As per FIG. 2, the plunger stop 20 of the solenoid drive 6 has a cylindrical section 27 which projects into the coil interior 25.

The solenoid housing 19 has, on a side facing toward the plunger 21, a face side wall 30 which has a passage opening 31 extended through axially by the plunger 21. The plunger stop 20 and the coil arrangement 22 are accommodated in the solenoid housing 19. The face side wall 30 has an edge region 32 which surrounds the passage opening 31 in the circumferential direction. Said edge region 32 is in this case spaced apart axially from a face side 33, facing toward the face side wall 30, of the cylindrical section 27.

The solenoid drive 6 is furthermore equipped with a guide sleeve 44 in which the plunger 21 is mounted in axially adjustable fashion. For this purpose, the guide sleeve 44 extends coaxially through the coil interior 25. Furthermore, the guide sleeve 44 is supported radially on the cylindrical section 27. Furthermore, the coil arrangement 22 is supported radially at the inside on said guide sleeve 44. Also, the edge region 32 of the face side wall 30 is supported radially at the inside on the guide sleeve 44. The plunger 21 slides along the guide sleeve 44.

The edge region 32 is in the form of a cylindrical sleeve. In this case, an axial length 40 of the sleeve-shaped edge region 32 is greater than the axial adjustment travel 36 of the plunger 21 covered by the latter between the active position AS and the passive position PS. In this case, with the embodiment of the abovementioned axial abutment, said adjustment travel 36 corresponds to the axial spacing between the face side 39 of the plunger 21 and the face end 33 of the cylindrical section 27 of the plunger stop 20.

The plunger 21 is furthermore coupled to a switching rod 45 which, for this purpose, at least partially extends through the plunger 21. The switching rod 45 serves for the axial adjustment of a contact element 46 which, in turn, serves for the electrical connection of two electrical contacts 47. By way of said electrical contacts 47, the electric motor 5 is connected to a main electrical supply 48. In other words, when the contact element 46 electrically connects the two electrical contacts 47 to one another, the electric motor 5 can be supplied, by way of the main electrical supply 48, with a rated electrical power in order that the electric motor 5 can output a rated torque at the pinion 7. To realize a so-called "soft-start process", it is possible for a considerably lower level of electrical power to be supplied to the electric motor 5 in order for the pinion 7 to be driven with a considerably lower torque for as long as it has not yet reached its active position AS. To this end usually the electrical power supply (not shown here) of the coil arrangement 22 is also used to operate the electric motor 5.

The switching rod 45 is led coaxially through the plunger stop 20. Accordingly, the plunger stop 20 is ultimately situated axially between the plunger 21 and the contact element 46. The plunger 21 is assigned at least one restoring spring 49 which, in the example, extends coaxially around the switching rod 45. In this case, the restoring spring 49 is supported at one side on the plunger 21 and at the other side on the plunger stop 20.

In the example of FIG. 2, the plunger 21 has, on its plunger end 39, a central recess 42 into which the restoring spring 49 protrudes. In addition or alternatively, the face end 33 may be equipped with a central recess 43 into which the restoring spring 49 protrudes. In this way, it is possible overall for an axially larger restoring spring 49 to be accommodated, whereby in particular, it is possible to realize a spring characteristic curve which is linear over the entire adjustment travel 36 of the plunger 21. Said adjustment travel 36 is the axial spacing 34 between the plunger end 39 and the face end 33.

The switching rod 45 is also assigned a restoring spring 50 which is supported at one side on the switching rod 45 and at the other side on a contact housing 51 on which the electrical contacts 47 are situated. Furthermore, a preload spring 52 may be provided which drives the contact element 46 in the direction of the contacts 47. Said preload spring 52 is in this case supported on the switching rod 45. As can be seen, an axial spacing between the contact element 46 and the contacts 47 is smaller than the overall travel of the plunger 21 between the passive position PS and the active position and AS. Thus, the contact element 46 comes into contact with the contacts 47 shortly before the active position AS is reached. When the active position AS is reached, the preload spring 52 then effects preloaded abutment of the contact element 46 against the contacts 47. Owing to the capacitive action of the coils/windings of the electric motor 5, the rated torque is built up after a time delay. Coordination is preferably performed such that the rated torque is present approximately at the same time as the active position AS is reached.

It can also be seen that, in the passive position PS, the contact element 46 bears axially against a face end 53, facing away from the plunger 21, of the plunger stop 20.

In the example shown here, the coil arrangement 22 has a coil carrier 54 which has a cylindrical body 55 and two end discs 56. The cylindrical body 55 extends coaxially with respect to the longitudinal central axis 24. The end discs 56 are expediently of planar form and extend annularly and perpendicular to the longitudinal central axis 24. Radially at the outside around the cylindrical body 55 and axially between the end discs 56, the coil arrangement 22 has at least one electrical coil 57. For example, it is possible for at least two different electrical coils 57 to be provided, specifically at least one retraction coil and at least one holding coil.

The coil arrangement 22 expediently performs a pre-assemblable coil structural unit in which the respective coil 57 is wound on the coil carrier 54. Furthermore, the plunger stop 20, guide sleeve 44 and coil arrangement 22 likewise form a pre-assemblable plunger stop structural unit which can be inserted in the preassembled state into the solenoid housing 19. Said plunger stop structural unit can also comprise the plunger 21, the switching rod 45, the contact element 46 and the respective springs 49, 52. Subsequently, the contact housing 51 can also be inserted and fixed for example by means of a flange connection 58 and/or by means of an adhesive connection 59.

In the assembled state, the coil carrier 54 bears by way of its end disc 56, shown on the right in FIG. 2, against an annular step 60 of the plunger stop 20.

According to FIG. 2 the coil arrangement 22 has two axially opposing end portions, namely a proximal end portion 62 and a distal end portion 63. The cylindrical section 27 of the plunger stop 20 extends from said distal end portion 63 into the coil interior 25 towards the proximal end portion 62. The plunger 21 protrudes from said proximal end portion 62 into the coil interior 25 at least in the active position AS of the pinion.

As per FIG. 2, the plunger 21 is in this case arranged axially opposite the cylindrical section 27, such that the face side 39 of the plunger 21 and the face end 33 of the cylindrical section 27 are situated axially opposite one another. In the active position AS of the pinion 7, the plunger 21 protrudes axially into the coil interior 25 of the coil arrangement 22. In the passive position PS of the pinion 7, it is the case as per FIG. 2 that the plunger 21 is, at least radially at the outside, axially arranged in the area of the proximal end portion 62. In this particular example, the plunger 21 is in this situation fully deployed out of the coil interior 25. This relationship is not evident in the case of the conventional solenoid drive 6 shown in FIG. 1.

In the preferred example shown, the face side 39 of the plunger 21 is of planar form, wherein the planar face side 39 extends perpendicular to the longitudinal central axis 24. In this case, in the passive position PS shown in FIG. 2, the plunger 21 is axially fully or almost fully deployed out of the coil interior 25. In particular, when the plunger 21 assumes its end position associated with the passive position PS of the pinion 7, there may even be an axial spacing between the face side 39 and an axial end 28 facing toward the plunger 21. In order that, for the adjustment of the pinion 7 into its active position AS, the plunger 21 can protrude into the coil interior 25, the face end 33 of the cylindrical section 27, which face end is expediently likewise planar and extends perpendicular to the longitudinal central axis 24, is likewise spaced apart from said axial end 28 of the coil arrangement 22. A corresponding axial spacing is denoted in FIG. 2 by "34". The face side 39 of the plunger 21, which may hereinafter also be referred to as "plunger end 39", expediently forms, together with the face end 33 of the cylindrical section 27, an axial abutment for the plunger 21, which defines the other end position of the plunger 21 and thus the active position AS of the pinion 7. In this case, in the active position AS of the pinion 7, the plunger end 39 comes to bear axially against the face end 33. Accordingly, the axial spacing 34 corresponds to an adjustment travel 36 of the plunger 21 covered by the latter between the active position AS and the passive position PS.

The edge region 32 of the face side wall 30 is expediently likewise entirely, or at least radially at the inside, arranged axially outside the coil interior 25. In FIG. 2, there is an axial gap 37 between the face side wall 30 and the axial end 28 of the coil arrangement 22. In the example of FIG. 2, in the passive position PS of the pinion 7, the plunger end 39 is situated in the region of said gap 37. Thus, in said passive position PS, the plunger end 39 is situated axially between the face side wall 30 and the axial end 28 of the coil arrangement 22. As a result, in the passive position PS, the plunger end 39 projects beyond the edge region 32 in the direction of the cylindrical section 27. It is likewise conceivable for the plunger end 39 and the edge region 32 to terminate flush with one another. In this case, it is then the case that the plunger end 39 terminates flush with an inner side 38, facing towards the plunger stop 20, of the face side wall 30. It is likewise conceivable that, in another embodiment, the plunger 21 is, by way of its plunger end 39, set back slightly in relation to said inner side 38 of the face side wall 30, such that the face side wall 30, at its inner side 38, projects slightly beyond the plunger end 39 in the direction of the plunger stop 20.

By means of this design, it is achieved that, at least in that end position of the plunger 21 which is associated with the passive position PS of the pinion 7, an intermediate space 41 is formed axially between the plunger 21 and the plunger stop 20, which intermediate space extends in an axial end section of the coil interior 25. The positioning of said intermediate space 41 in the axial end section of the coil arrangement 22 yields a significant reduction of the density of field lines in the region of said intermediate space 41. The corresponding magnetic flux flows from the solenoid housing 19 through the plunger 21 to the plunger stop 20. Accordingly, the magnetic attractive force which is imparted by the solenoid drive 6, which pulls the plunger 21 into the coil interior 25 when the coil arrangement 22 is energized, is correspondingly reduced. The greater the extent to which the plunger 21 is adjusted into the coil interior 25 during the adjustment of the pinion 7 from the passive position PS into the active position AS, the smaller the axial spacing 34 becomes, and accordingly, the smaller the axial dimension of the intermediate space 41 also becomes. As a result, it is now possible for the density of the field lines, which extend through the plunger 21, to increase, resulting in a corresponding increase of the magnetic forces acting on the plunger 21.

In the example of FIG. 2, the adjustment travel 36 of the plunger 21, that is to say the axial spacing 34 between the plunger end 39 and face end 33, in the passive position PS is smaller than a diameter 61 of the plunger 21 or of the cylindrical section 27 of the plunger stop 20. In this case, the axial spacing 34 is however greater than half of the diameter 61.

As also can be derived from FIG. 2, the cylindrical section 27 extends over more than 50% of an axial length 66 of the coil arrangement 22. In the specific embodiment depicted in FIG. 2 the cylindrical section 27 extends over at least 70% of the axial length 66 of the coil arrangement 22. Furthermore, the cylindrical section 27 has a cylindrical radial outer wall 64 which axially ends at the face end 33 of the cylindrical section 27. The face end 33 of the cylindrical section 27 has a radial outer rim 65 at said cylindrical outer wall 64. As can be seen the radial outer rim 65 is arranged closer to the proximal end portion 62 than to the distal end portion 63. Furthermore, the radial outer wall 64 of the cylindrical section 27 extends over more than 50% of an axial length 66 of the coil arrangement 22. In the specific depicted embodiment the radial outer wall 64 of the cylindrical section 27 extends over at least 70% of the axial length 66 of the coil arrangement 22.

Additionally, FIG. 2 discloses that the solenoid housing 19 has said edge region 32 bordering the passage opening 31 in a circumferential direction, wherein said edge region 32 has an axial length 40 which is greater than the aforementioned axial spacing 34 between the face-side plunger end 39 and the face end 33 of the cylindrical section 27 in the passive position PS. In this specific embodiment said edge region 32 has an axial length 40 which is at least 30% of an axial length 67 of the plunger 21. Additionally, said edge region 32 has an axial length 40 which is at least 30% of a diameter 68 of the plunger 21.

The invention claimed is:

1. A starter for an internal combustion engine, comprising:

a support;

an electric motor arranged on the support for driving a pinion in rotation;

a solenoid drive arranged on the support configured to axial adjust the pinion between an active position for driving a gearwheel of an internal combustion engine, and a passive position axially offset with respect to the active position;

the solenoid drive including a ferromagnetic plunger stop structured and arranged to remain static with respect to the support, a plunger axially adjustable relative to the plunger stop, and a cylindrical coil arrangement arranged on the plunger stop surrounding a cylindrical coil interior in a circumferential direction;

the coil interior extending axially from a proximal end of the coil arrangement to a distal end of the coil arrangement;

the plunger stop including a cylindrical section projecting axially into the coil interior from the distal end of the coil arrangement;

the plunger arranged axially opposite the cylindrical section of the plunger stop and, when the pinion is in the active position, protruding axially into the coil interior from the proximal end of the coil arrangement;

wherein, when the pinion is in the passive position, a face-side plunger end of the plunger facing towards the cylindrical section is arranged axially in an area of the proximal end of the coil arrangement; and wherein the cylindrical section extends into the coil interior such that a face end of the cylindrical section facing towards the plunger is closer to the proximal end of the coil arrangement than to the distal end of the coil arrangement.

2. The starter according to claim 1, wherein the cylindrical section extends over more than 50% of an axial length of the coil arrangement.

3. The starter according to claim 2, wherein the cylindrical section extends over at least 70% of the axial length of the coil arrangement.

4. The starter according to claim 1, wherein:

the cylindrical section includes a cylindrical radial outer wall that axially ends at the face end of the cylindrical section;

the face end of the cylindrical section includes a radial outer rim at the cylindrical outer wall; and the radial outer rim is arranged closer to the proximal end of the coil arrangement than to the distal end of the coil arrangement.

5. The starter according to claim 1, wherein the cylindrical section includes a cylindrical radial outer wall that axially ends at the face end of the cylindrical section, and wherein the radial outer wall extends over more than 50% of an axial length of the coil arrangement.

6. The starter according to claim 5, wherein the radial outer wall extends over at least 70% of the axial length of the coil arrangement.

7. The starter according to claim 1, wherein:

the solenoid drive further includes a ferromagnetic solenoid housing fastened to the support, the housing including a face side wall and a passage opening disposed in the face side wall;

the passage opening is extended through axially by the plunger; and the coil arrangement is arranged within the housing such that the coil interior is coaxial with the passage opening, the coil interior and the passage opening having substantially identical radial cross sections.

8. The starter according to claim 1, wherein the solenoid drive further includes a ferromagnetic solenoid housing fastened to the support, the housing including a face side wall, a passage opening disposed in the face side wall, and an edge region structured as a cylindrical sleeve projecting from the face side wall bordering the passage opening in a circumferential direction, the edge region having an axial length greater than an axial spacing between the face-side plunger end and the face end of the cylindrical section when the pinion is in the passive position.

9. The starter according to claim 7, wherein the solenoid housing includes a cylindrical edge region projecting from the face side wall bordering the passage opening in a circumferential direction, the edge region having an axial length at least 30% of an axial length of the plunger.

10. The starter according to claim 9, wherein the edge region has an axial length at least 30% of a diameter of the plunger.

11. The starter according to claim 7, wherein the face side wall, in an edge region bordering the passage opening in a circumferential direction, is spaced apart axially from the face end of the cylindrical section and is arranged entirely axially outside the coil interior.

12. The starter according to claim 11, wherein, when the pinion is in the passive position, the face-side plunger end is arranged axially adjacent to an inner side, facing towards the cylindrical section, of the face side wall at least in the edge region thereof.

13. The starter according to claim 1, wherein, when the pinion is in the active position, the face-side plunger end bears axially against the face end of the cylindrical section.

14. The starter according to claim 1, wherein the plunger is mounted in an axially adjustable fashion within a cylindrical guide sleeve that extends coaxially through the coil interior and is supported radially on the cylindrical section.

15. The starter according to claim 1, wherein the plunger is coupled via a diverting lever to a drive shaft connected rotationally conjointly to the pinion for axially adjusting the drive shaft, such that, during an adjustment of the pinion from the passive position into the active position, the plunger and the pinion are adjusted in opposite directions.

16. The starter according to claim 1, wherein:

the plunger is connected via a switching rod to a contact element, the contact element configured to facilitate an electrical connection of two electrical contacts that connect the electric motor to a main electrical supply; and the switching rod extends coaxially through the plunger stop, such that the plunger stop is arranged axially between the plunger and the contact element.

17. The starter according to claim 16, wherein, when the pinion is in the passive position, the contact element bears axially against a face end, facing away from the plunger, of the plunger stop.

18. The starter according to claim 1, wherein the coil arrangement includes a coil support including a cylindrical body and two end discs, the coil arrangement further including at least one electrical coil arranged between the two end discs and radially at an outside on the cylindrical body.

19. The starter according to claim 18, wherein the coil support via at least one of the two end discs bears axially against an annular step of the plunger stop.

20. The starter according to claim 1, wherein the coil arrangement includes a coil support including two end discs, a cylindrical body extending between the two end discs, and wherein a first end disc of the two end discs defines the proximal end of the coil arrangement and a second end disc of the two end discs defines the distal end of the coil arrangement.

21. A starter for an internal combustion engine, comprising:

a support;

an electric motor arranged on the support for driving a pinion in rotation;

a solenoid drive arranged on the support configured to axial adjust the pinion between an active position for driving a gearwheel of an internal combustion engine, and a passive position axially offset with respect to the active position;

the solenoid drive including a ferromagnetic plunger stop structured and arranged to remain static with respect to the support, a plunger axially adjustable relative to the plunger stop, and a cylindrical coil arrangement arranged on the plunger stop surrounding a cylindrical coil interior in a circumferential direction;

the coil interior extending axially from a proximal end portion of the coil arrangement to a distal end portion of the coil arrangement;

the plunger stop including a cylindrical section projecting from the distal end portion axially into the coil interior;

the plunger arranged axially opposite the cylindrical section of the plunger stop and, when the pinion is in the active position, protruding from the proximal end portion axially into the coil interior;

wherein, when the pinion is in the passive position, a face-side plunger end of the plunger facing towards the cylindrical section is arranged axially in an area of the proximal end portion;

wherein the cylindrical section extends into the coil interior such that a face end of the cylindrical section facing towards the plunger is closer to the proximal end portion than to the distal end portion; and wherein, when the pinion is in the passive position, the face-side plunger end is arranged axially out of the coil interior.

22. A starter for an internal combustion engine, comprising:

a support;

an electric motor arranged on the support for driving a pinion in rotation;

a contact element configured to facilitate an electrical connection of two electrical contacts that connect the electric motor to a main electrical supply;

a solenoid drive arranged on the support configured to axial adjust the pinion between an active position for driving a gearwheel of an internal combustion engine, and a passive position axially offset with respect to the active position;

the solenoid drive including a ferromagnetic plunger stop structured and arranged to remain static with respect to the support, a plunger axially adjustable relative to the plunger stop, and a cylindrical coil arrangement arranged on the plunger stop surrounding a cylindrical coil interior in a circumferential direction;

the coil interior extending axially from a proximal end portion of the coil arrangement to a distal end portion of the coil arrangement;

the plunger stop including a cylindrical section projecting from the distal end portion axially into the coil interior;

the plunger arranged axially opposite the cylindrical section of the plunger stop and, when the pinion is in the active position, protruding from the proximal end portion axially into the coil interior;

wherein, when the pinion is in the passive position, a face-side plunger end of the plunger facing towards the cylindrical section is arranged axially in an area of the proximal end portion;

wherein the cylindrical section extends into the coil interior such that a face end of the cylindrical section facing towards the plunger is closer to the proximal end portion than to the distal end portion; and wherein the plunger is connected to the contact element and, when the pinion is in the passive position, the contact element bears axially against a face end of the plunger stop facing away from the plunger.

* * * * *